US005137173A

United States Patent [19]

Hughes et al.

[11] Patent Number: 5,137,173

[45] Date of Patent: Aug. 11, 1992

[54] SHEET DISPENSERS

[75] Inventors: Stephen P. Hughes, London; Ian E. Wood, Hertford, both of England

[73] Assignee: Kimberly-Clark Limited, Maidstone, United Kingdom

[21] Appl. No.: 577,402

[22] Filed: Sep. 4, 1990

[30] Foreign Application Priority Data

Sep. 1, 1989 [GB] United Kingdom ..... 8919830

[51] Int. Cl.[5] ..... B65H 1/00

[52] U.S. Cl. ..... 221/34; 221/45; 221/48; 221/62; 221/63; 221/154

[58] Field of Search ..... 221/34, 45, 46, 47, 221/49, 50, 61, 62, 63, 154; 292/35, 36, 40, 41

[56] References Cited

U.S. PATENT DOCUMENTS

| | | | |
|---|---|---|---|
| D. 185,775 | 7/1959 | Plotkin et al. . | |
| D. 224,439 | 7/1972 | Engel . | |
| D. 236,174 | 8/1975 | Bahnson . | |
| D. 284,247 | 6/1986 | Fine . | |
| 757,733 | 4/1904 | Frank | 292/36 |
| 896,928 | 8/1908 | Meyer | 292/36 |
| 907,928 | 12/1908 | Wheeler | 221/34 |
| 1,038,457 | 9/1912 | Swift | 221/50 |
| 1,685,862 | 10/1928 | Parker . | |
| 2,158,712 | 5/1939 | West | 221/49 |
| 2,488,040 | 11/1949 | Straubel | 221/62 |
| 2,689,059 | 9/1954 | Nudell | 221/63 |
| 2,826,230 | 3/1958 | Conell | 221/46 |
| 3,010,607 | 11/1961 | Probasco | 221/154 |
| 3,269,593 | 8/1966 | Lodewick et al. | 221/63 |
| 3,291,411 | 12/1966 | Kreuger . | |
| 3,432,217 | 3/1969 | Cowan | 312/242 |
| 4,586,630 | 5/1986 | Loder | 221/46 |
| 4,790,490 | 12/1988 | Chakravorty . | |

FOREIGN PATENT DOCUMENTS

| | | |
|---|---|---|
| 2218866 | 9/1974 | France . |
| 917049 | 1/1963 | United Kingdom . |
| 1170426 | 11/1969 | United Kingdom . |
| 2031382A | 4/1980 | United Kingdom . |

*Primary Examiner*—H. Grant Skaggs
*Attorney, Agent, or Firm*—William D. Herrick

[57] ABSTRACT

A dispenser for dispensing disposable wipes or the like having an aperture (30) in one face of the dispenser through which wipes may be dispensed. The aperture comprises a central opening (32) and two relatively thin elongated openings (34) which extend out from either side of the central opening. Protuberances (38) protrude into the elongated openings (34) from each side thereof. The protuberance from one side of each opening is preferably located adjacent to the corresponding protuberance from the other side, in a staggered arrangement.

A dispenser is also provided which comprises a hopper (4) to hold at least one stack of wipes, the hopper being receivable in and pivotally attached to an outer casing (6), in such a way that with the outer casing resting on the ground, or secured to a wall, the hopper may be opened in order to insert a stack of wipes.

8 Claims, 4 Drawing Sheets

SHEET DISPENSERS

This invention relates to dispensers suitable for dispensing products such as disposable wipes hand towels, tissues or the like made from paper, cellulose wadding or non-woven fabrics (hereafter referred to as "wipes") and more particularly to dispensers of the type which hold a stack of wipes, the wipes being dispensed through a dispensing hole in one face of the dispenser.

The wipes may be Z folded, whereby each wipe is attached to adjacent wipes by perforations and the long strip of perforated wipes is folded in zig-zag like folds, the perforations being offset from the folds. A wipe is pulled down through the opening, so that when the row of perforations reaches or passes beyond the dispenser outlet, the dispensed wipe may be torn off from the remaining wipes.

Alternatively two zig-zag strips of wipes are interfolded, with the perforations of one strip offset from those of the other, so that if one strip is pulled down until a row of perforations reaches or passes beyond the outlet of the dispenser, the other strip is also partly pulled out from the dispenser, so that it may be grasped by the next user.

One problem encountered with known dispensers is that, during dispensing, when one wipe is pulled from the dispenser by a user, the strip tends to "streams" out from the outlet. This is obviously an undesirable feature since more wipes will be used than necessary.

Further, in known dispensers of the type described above the wipe being dispensed tends to become bunched up in the center of the dispensing opening, so that the wipe is not dispensed as a smooth flat sheet. Also, most dispensers are mounted on a wall and may not be moved to where the towels or wipes are actually needed, for example in the work bay of a garage.

It is a general object of the invention to provide a dispenser which is capable of dispensing wipes without streaming and in a smooth manner, irrespective of the direction in which the towel is pulled out.

A dispenser in accordance with the invention for dispensing disposable wipes or the like has an aperture in one face of the dispenser through which wipes may be dispensed, the aperture comprising a central opening and two relatively thin elongated openings which extend out from either side of the central opening and which have protuberances which protrude into the elongated openings from each side thereof.

Preferably the protuberance from one side of each opening is located adjacent to the corresponding protuberance from the other side.

A wipe passes around and between the protuberances, the protuberances providing frictional resistance when the wipe is pulled from the dispenser, to aid in preventing the strip of towels from streaming out of the dispenser. The protuberances also prevent the wipe bunching up in the central opening and prevent the wipe falling back into the dispenser if the dispenser is lying on its "top" face.

Suitably the elongated openings have bulbous outer ends so that the wipe being dispensed does not jam in the outer edges of the aperture, especially when a wipe is extracted at an acute angle.

In accordance with another aspect of the invention a dispenser for dispensing disposable wipes or the like comprises a hopper to hold at least one stack of wipes, and having a dispensing outlet in one face, the hopper being receivable in and pivotally attached to an outer casing in such a way that with the outer casing resting on the ground, or secured to the wall, the hopper may be opened in order to insert a stack of wipes.

Means are preferably provided to limit the arcuate movement of the hopper relative to the outer casing.

Such a dispenser may be used in a number of orientations as required by the user. It may be hung on a wall with the dispensing opening facing downwards or it may rest on the "back" or "top" face of the outer casing, so that the aperture extends horizontally or upwardly, respectively.

Preferably the hopper is provided with two chambers so that a greater number of towels may be stored than in conventional dispensers.

Ribs are preferably provided on the inner surface of the outer casing so positioned as to prevent the towels falling into the casing and jamming the dispenser when, for example, the dispenser is being carried. Ribs may also be provided on the interior of the hopper, to aid in dispensing the wipes.

In accordance with another feature of the invention means are provided for locking the hopper in at least two positions in the casing, for example with the hopper "closed" or "fully opened". This is preferably achieved by a lock mechanism which comprises a central rotatable member having two arms extending therefrom which engage with two movable locking members, the locking members being biased into a locking position by springs and engaging with complementary catches located on the hopper, the locking members being released from their locking position when the central member is rotated.

The catches are suitably located on the front and rear of the hopper and engage with holes provided in the ends of the locking members.

The ends of the locking members also preferably have sloping surfaces over which the catches cam in order to lock the hopper in position automatically without using a key. In use a key is rotated to unlock the hopper from the outer casing. The hopper is then pivoted to the opened position, where it is automatically locked in place by means of the catch located on the rear of the hopper which engages with the locking members. The hopper may then be filled with wipes. The hopper is unlocked by rotating the key to release the locking members. The hopper will then either fall shut, owing to its own weight or be closed by the user, the locking members automatically engaging with the catch located on the front of the hopper and locking the hopper in a closed position. The key may be permanent or may be removable to prevent anyone other than authorised persons from opening the hopper.

In accordance with another aspect of the invention a stack of wipes is surrounded by a sleeve having a tab and a row of perforations extending transversely across the sleeve, adjacent to the tab.

With such an arrangement the sleeve, complete with towels or the like, may be picked up by means of the tab and placed in the dispenser. The perforations are then broken, allowing the sleeve to be removed whilst leaving the stack of wipes in the dispenser.

The sleeve is made preferably from paper, polythene or other flexible wrapping material and suitably the tab is integral with the sleeve.

The invention will now be described by way of example with reference to the accompanying drawings in which:

FIG. 4 is a detailed view of the aperture of the dispenser shown in FIG. 2; and.

Figure 1:
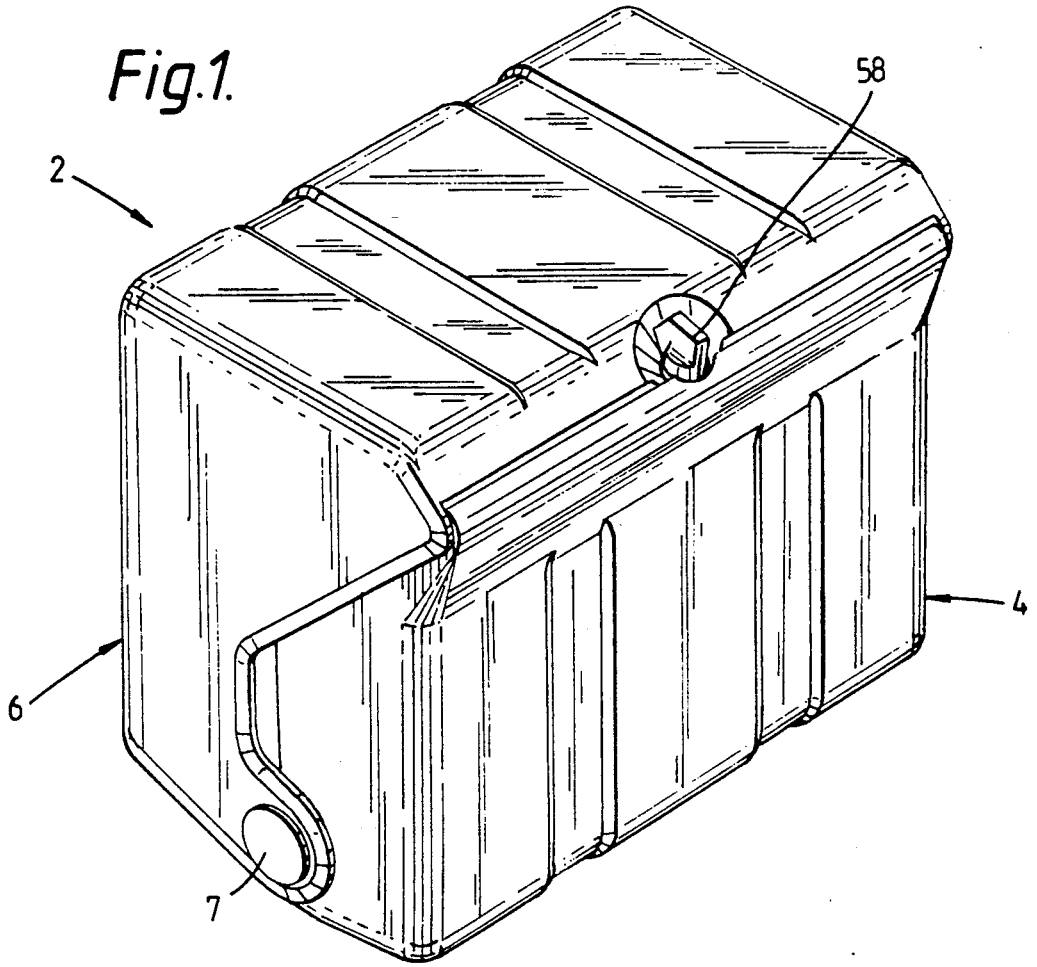
FIG. 1 is a perspective view of a dispenser in accordance with the invention in a closed position.

The dispenser generally indicated at 2 consists of a hopper 4 for storing the products to be dispensed, such as disposable wipes, hand towels or the like and an outer casing 6. The hopper 4 is receivable within and pivotally connected to outer casing 6 and 7. A stub 8 (see FIG. 2) is provided on the side of the hopper 4 and engages with an arcuate groove 10 in the side of the outer casing, the length of the groove determining the limit of the arcuate movement of the hopper 4 relative to the casing 6.

The hopper 4, which holds stacks of wipes 16, has two chambers 12, 14 providing a capacity significantly greater than conventional dispensers and the potential to hold two types of wipes at the same time.

Attaching means 13 are provided on the outer casing of the dispenser so that the dispenser may be attached to a wall. Alternatively, the dispenser may be free-standing so that it may be used where required, in any orientation. If the dispenser is placed with the "back" face 17 of the outer casing downwards, the attaching means 13 act as feet to provide a stable base. Ribs 15 are provided on the inner surface of the outer casing 6 to prevent the wipes falling into the casing and so jamming the dispenser when the dispenser is carried "upside down".

Figure 3:
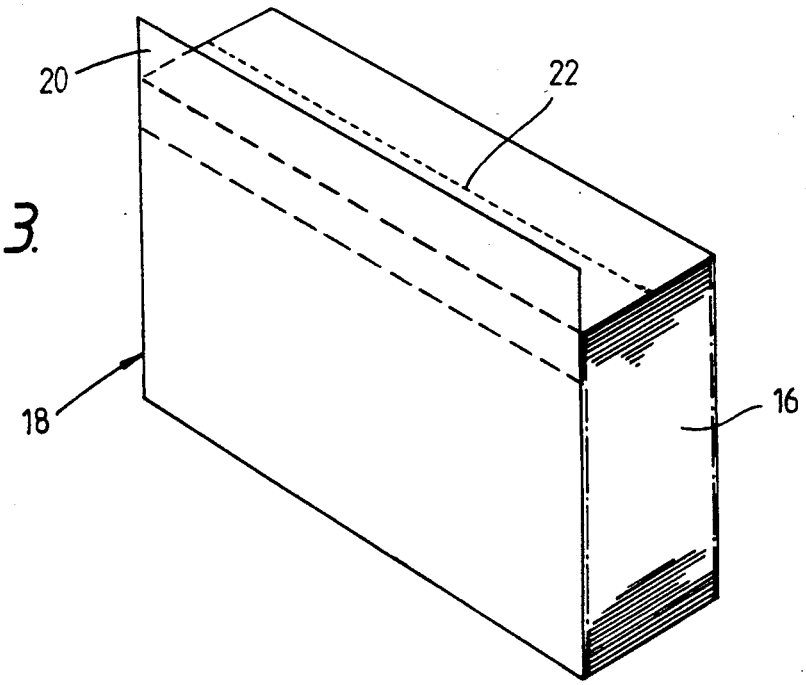
FIG. 3 is a perspective view of a sleeve for holding a stack of wipes or the like, in accordance with another aspect of the invention.

Each stack of wipes 16 is surrounded by a sleeve 18 to keep the stack in order. The sleeve 18 is provided with a tab 20 and a transverse row of perforations 22 (see FIG. 3). When the stack 16 is placed in the hopper 4, it is held by means of the tab 20. When the stack is in place, the perforations 22 are broken. The sleeve 18 can then be removed, leaving the stack of wipes 16 ready to be dispensed.

Figure 4:
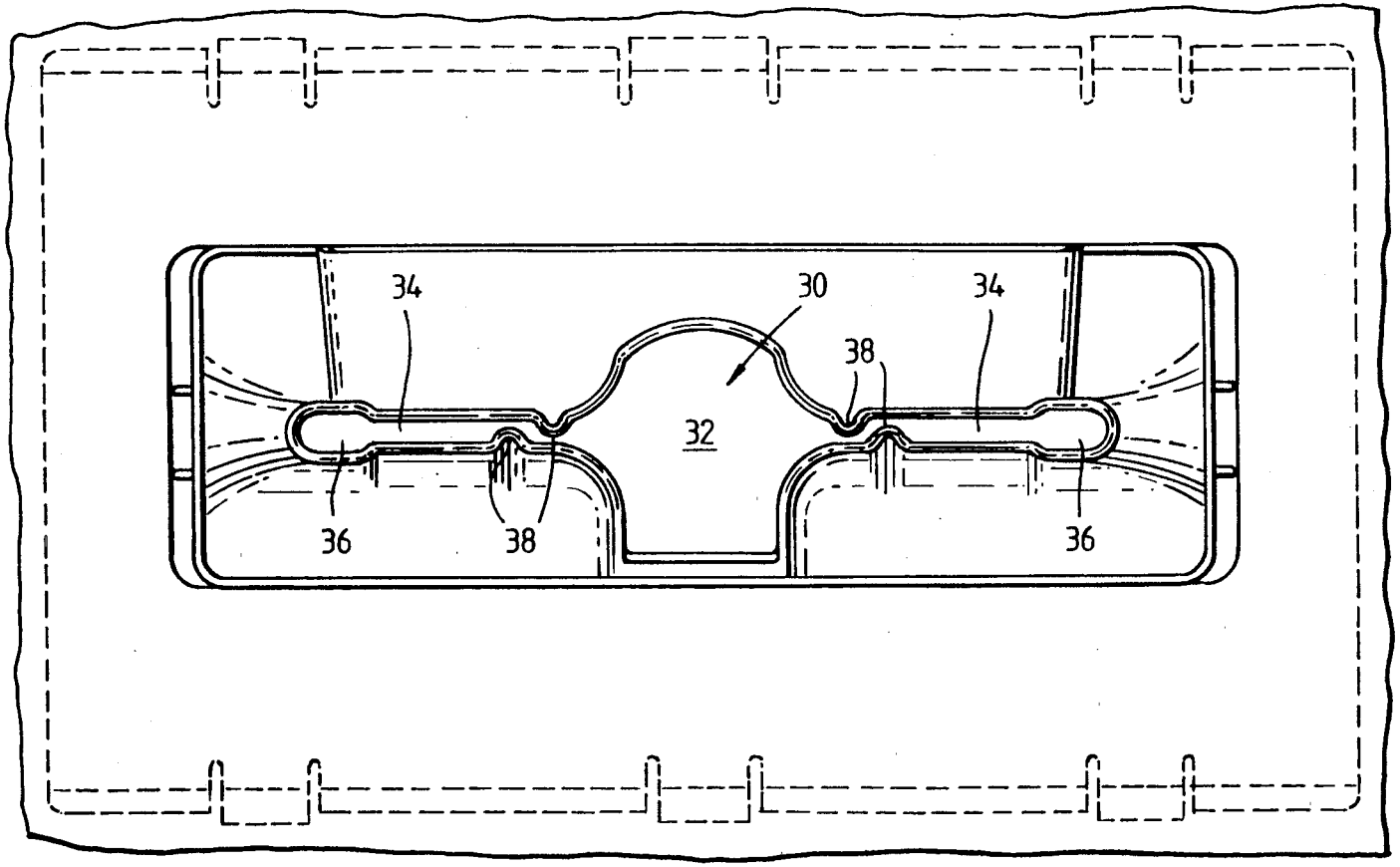

The dispenser 2 has an aperture 30 (see FIG. 4) through which the wipes may be dispensed. The aperture 30 has a large central opening 32 and two thin elongated openings 34 which extend out from either side of the central opening 32. The large central opening 32 allows a user to grab a wipe from within the disperser, should part of one not be protruding therefrom. The elongated openings or slots do not extend to the sides of the dispenser and are provided with bulbous ends 36, the wide arc preventing the towel from jamming at the ends of the slots, especially when the towel is extracted from the dispenser at an acute angle.

Protuberances 38 protrude into the elongated openings 34 from each side thereof, the protuberances from one side of the elongated openings being located adjacent those extending from the other side of the elongated openings.

The protuberances provide a tortuous path for a wipe extending through the aperture, the wipe passing around and between the protuberances. On pulling a wipe through the aperture the protuberances provide frictional resistance so preventing the whole strip of wipes from "streaming" through the aperture. The protruding members 38 also prevent the edges of the wipes from slipping into the central opening 32 when a wipe is dispensed. The wipe is therefore dispensed in a relatively smooth manner, rather than bunched up.

The aperture preferably allows one strip of wipes to be dispensed at a time, but may be adapted to allow more to be dispensed.

The aperture may be formed as an integral part of the hopper 4 or may be removable therefrom. Apertures of different sizes may then be provided to allow towels of various thicknesses to be dispensed. The aperture also protrudes from the face of the hopper (as shown in FIG. 2) to assist in dispensing the wipe as a smooth sheet.

Figure 2:
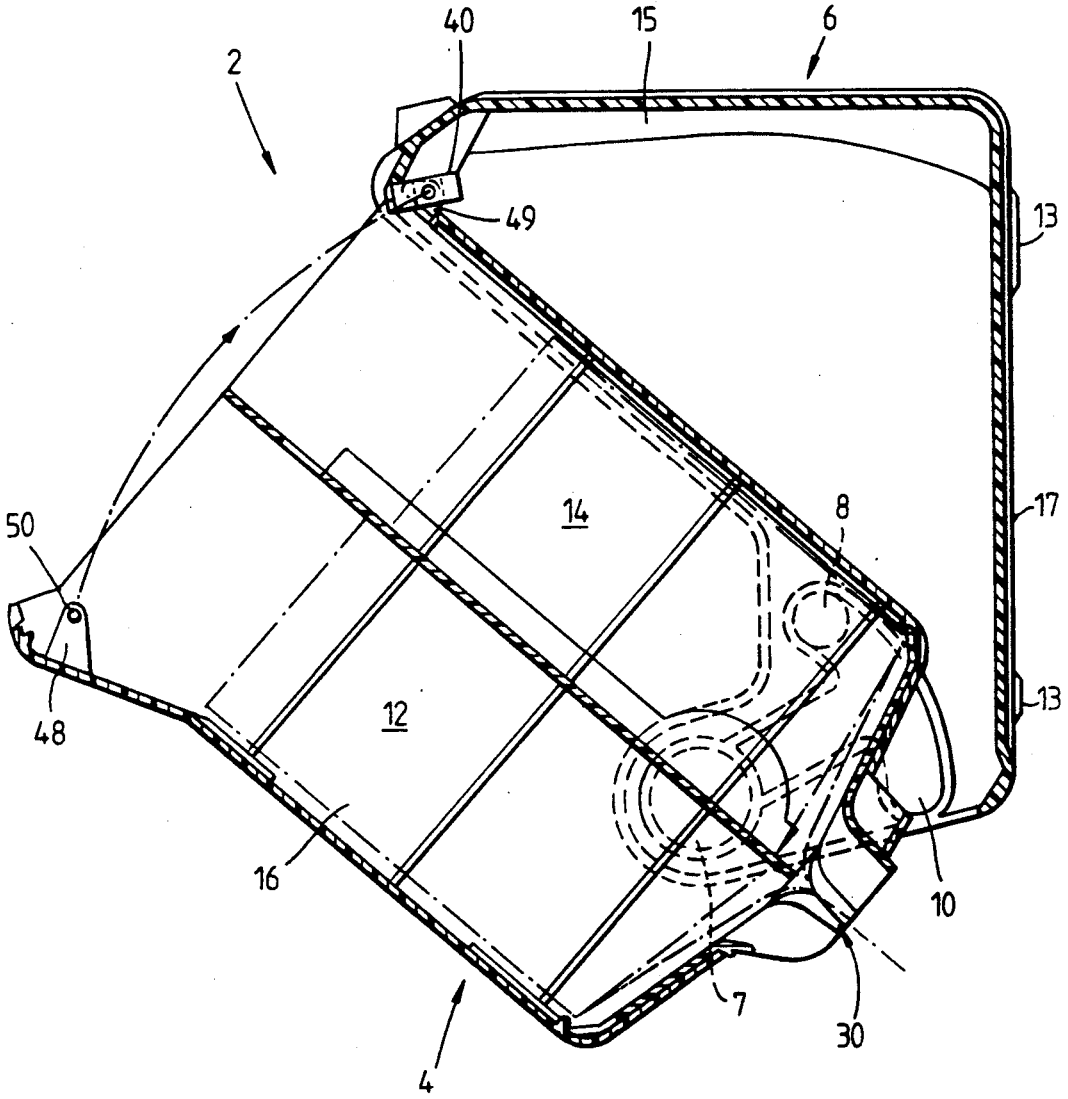
FIG. 2 is a cross-section of the dispenser shown in FIG. 1, the dispenser being in an open position.

In order to lock the hopper 4 in a fully closed position (as shown in FIG. 1) or in a fully opened position (as shown in FIG. 2) a lock 40 is attached to the outer casing 6.

Figure 5:
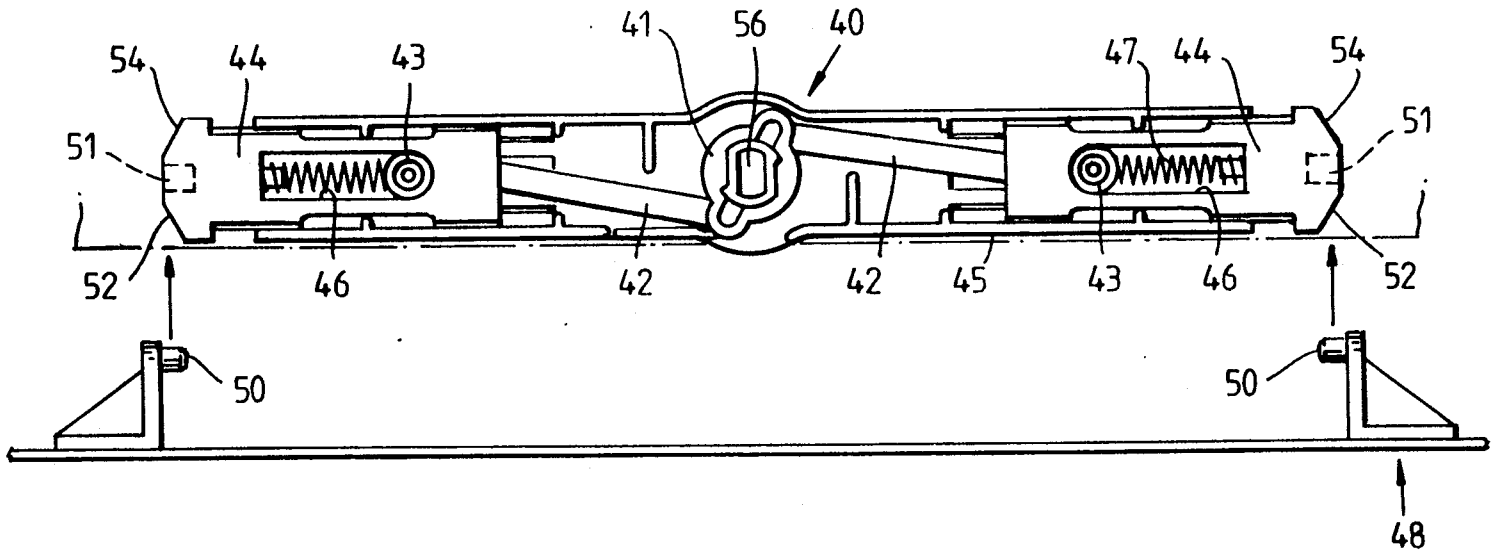
FIG. 5 is a plan view of a lock for the dispenser illustrated in FIGS. 2 and 3.

As shown in FIG. 5, lock 40 has a central rotatable member 41 and two locking members 44. Two arms 42 are pivotally connected to opposite sides of the central member at one of their ends and to a locking member 44 at the other. The locking members 44 are slidable within a housing 45 on which a circular pin 43 is mounted, the pin 43 engaging with a longitudinal slot 46 provided in each locking member 44. A spring 47 is connected between the pin 43 and the outer end of the slot 46 to bias the outer end of the locking members 44 away from the pin 43 and hence outwardly from the central member 41. A hole is provided through the center of the circular pin 43 so that the lock 40 may be mounted on the outer casing 6 of the dispenser 2 by means of a screw or the like.

Catches 48, 49 are provided on the front and rear of the hopper respectively. Each catch 48, 49 has a peg 50 which mates with complementary holes 51 provided in the outer ends of the locking members 44. The outer ends of the locking members are also provided with sloping surfaces 52, 54.

When the hopper is closed, pegs 50 of catch 48 cam over the sloping surfaces 52 of the movable locking members 44, so causing the locking members 44 to move inwards against the force of the spring 47. When the pegs 50 become level with holes 51, the locking members 44 will move outwards, under the bias of the spring, and engage the pegs 50. The hopper is thus locked in a closed position until the central member 41 is rotated.

When this occurs, the hopper may be opened and, as it reaches its limit, pegs 50 of catch 49 cam over sloping surfaces 54 in the same manner to lock the hopper in an open position, to enable it readily to be filled with fresh wipes or the like.

A key hole 56 is provided in the central rotatable member 41. When a key 58 is inserted and rotated to unlock the hopper 4, the central member 41 rotates, so pulling the arms 42, and hence the locking members 44, inwards against the bias of the spring 47. The hopper may then be pivoted and the spring 47 will restore the locking members 44 to their equilibrium position once the key 58 is released, so enabling the hopper to automatically lock in the other position.

The key may be fixed, in which case the key hole is provided in a recess in the outer casing 6 so that the key 58 will not be damaged if the dispenser is placed on its "top" face. Alternatively, the key may be removable so that only authorised persons are able to open the hopper.

We claim:

1. A dispenser adapted to be wall mounted comprising a casing and a hopper pivotally attached to said casing to hold a stack of disposable wipes or the like, and having an aperture in one face through which the wipes may be dispensed, the aperture comprising a central opening and two relatively thin elongated openings which extend out from either side of the central opening, and protuberances protruding into each elongated opening from each side thereof in a staggered arrangement adjacent those protruding from the other side.

2. A dispenser as claimed in claim 1 wherein the elongated openings have bulbous outer ends, the width of the bulbous outer end being greater than the width of the elongated openings.

3. A dispenser for dispensing disposable wipes or the like as claimed in claim 1 or claim 2 wherein, with said casing resting on the ground or secured to a wall, the hopper may be opened in order to insert a stack of wipes.

4. A dispenser as claimed in claim 3 comprising means to limit the arcuate movement of the hopper relative to said casing.

5. A dispenser as claimed in claim 3 in which the hopper is provided with two chambers, each communicating with the dispensing outlet.

6. A dispenser as claimed in claim 1 or claim 2 further including locking means on said casing, said locking means comprising a central rotatable member having at least two arms extending therefrom which engage with respective movable locking members, the locking members being biased into a locking position and engageable with complementary catches, the locking members being released from their locking position when the central member is rotated.

7. A dispenser as claimed in claim 6 wherein the locking members have sloping surfaces over which the catches cam when the two are brought into contact, causing the locking members to move against the bias.

8. A dispenser as claimed in claim 6, the front end rear of the hopper being provided with said catches such that the hopper may be locked in a closed or fully opened position.

* * * * *